United States Patent [19]

Endo et al.

[11] 4,427,397

[45] Jan. 24, 1984

[54] METHOD FOR FORMING ELECTRON GUN ELECTRODES

[75] Inventors: Satoru Endo, Mobara; Masaaki Yamauchi, Togane, both of Japan

[73] Assignee: Hitachi, Ltd., Tokyo, Japan

[21] Appl. No.: 276,039

[22] Filed: Jun. 22, 1981

[30] Foreign Application Priority Data

Aug. 1, 1980 [JP] Japan ..... 55-105000

[51] Int. Cl.[3] ..... H01J 9/14

[52] U.S. Cl. ..... 445/49; 72/356

[58] Field of Search ..... 29/25.18, 163.5 R; 72/335, 356; 445/49

[56] References Cited

U.S. PATENT DOCUMENTS 3,412,593 11/1968 Price ..... 72/356 X 3,987,329 10/1976 Yoshida et al. ..... 313/314

FOREIGN PATENT DOCUMENTS 53-70664 6/1978 Japan ..... 29/25.18

55-66840 5/1980 Japan .

55-74036 6/1980 Japan ..... 29/25.18

*Primary Examiner*—Kenneth J. Ramsey

*Attorney, Agent, or Firm*—Charles E. Pfund

[57] ABSTRACT

An electron gun electrode of a color picture tube is manufactured by forming three spaced openings through a metal plate; squeezing the metal plate to form three inverted cup shaped cylindrical projections having the openings at their top centers; coining inner peripheries of the openings to enlarge the same and to form bevelled portions around the peripheries of the enlarged openings; and increasing inner diameters of the cylindrical projections thereby obtaining the electrode integrally formed with three adjacent cylindrical projections.

4 Claims, 24 Drawing Figures

100
101
101a
101b
103
104
10
12
108
108a
109
110
106a
106b
107
105
14
117
118a
118b
119
113a
113b
114
112
16
d1
d2
d3

METHOD FOR FORMING ELECTRON GUN ELECTRODES

BACKGROUND OF THE INVENTION

This invention relates to a method of forming electron gun electrodes which have the same performance and are constructed integrally as in the three electron guns of a color picture tube.

As shown in FIG. 1, a conventional in-line type electron gun structure utilized in a color picture tube comprises a flat plate shaped cathode holder 1 and three parallel cathode electrodes 2 heated by cathode heaters 3 contained therein for emitting electron beams. In front of the cathode electrodes 2, there are serially disposed a first grid electrode 4 for controlling the electron beams, a second grid electrode 5 for accelerating the electron beams, third and fourth grid electrodes 6 and 7 constituting an electron lens, which are supported by a bead glass rod 8. The electron beams passing through the electron lens impinge upon phosphor picture elements on the inner surface of the panel of the color picture tube, not shown.

The third and fourth grid electrodes are also called main lens electrodes and provided with a pair of three cylindrical projections 6*a*, 6*b*, 6*c* and 7*a*, 7*b*, 7*c*, each pair being formed in opposing cylindrical grid electrodes 6 and 7 and corresponding cylindrical projections being in axial alignment. The length L and the inner diameter D of each cylindrical projection should have a ratio larger than above 0.5 and the degree of true circle of the inner bore of the cylindrical projection should have an accuracy of less than 40 microns.

It has already been proposed to manufacture the main lens electrodes by integrally forming three lenses each having cylindrical projections having a ratio L/D larger than 0.5 as disclosed in Japanese Preliminary Publication of Pat. No. 66840/1976 dated May 20, 1970. According to this method, at first, perforations 12 having a predetermined inner diameter d1 are formed through a blank plate 10 as shown in FIG. 2A. Then as shown in FIG. 2B cylindrical projections 14 are formed by squeezing. At this time, the inner diameter d1 of the openings 12 is increased to d2 due to elongation of the blank. Then, openings 16 having larger inner diameter d3 are formed as shown in FIG. 2C. Then as shown in FIG. 2D, top ends of the projections are removed by boring or burring to obtain top opened cylindrical projections. Under this state, stress caused by the boring remains in the cylindrical projections 18 which results in an elastic deformation tending to decrease the inner diameter of the top openings 19, so that it is impossible to obtain a degree of true circle of the inner diameter of less than 40 microns that is required for the main lens electrodes. For this reason, the inner wall 20 of each cylindrical projection 18 is subjected to a strong squeezing operation to enlarge the inner diameter to D. As a consequence, it is impossible to form lenses 22*a*, 22*b* and 22*c* having cylindrical projections 21*a*, 21*b* and 21*c* and having a ratio L/D of larger than 0.5.

With this method, however, since strong squeezing force is applied to the cylindrical projections to plastically deform them, when one of the cylindrical projections 21*a*, 21*b* and 21*c* shown in FIG. 2E is depicted in an enlarged scale it can be shown in FIG. 3. Thus, as a result of strong squeezing force, the inner surface of the cylindrical projection is elongated extremely to form a sharp edge 23 at the upper end of the opening 18. This sharp edge 23 is not uniform throughout the entire periphery of the opening 19 and often takes the form of irregular wavy form. This decreases the degree of true circle thus affecting the focussing characteristic of the color picture tube. Where jigs are inserted into the openings 18 for assembling the main lens electrodes, the jigs may contact with the sharp edges 23 thus degrading the true circle. For this reason, the yield of the lens electrodes having a high accuracy would be decreased. When the sharp edges 23 are tumbled to eliminate them, the edges would project into openings 18 so that it is necessary to remove the projected edges by hand work.

SUMMARY OF THE INVENTION

Accordingly, it is an object of this invention to provide a method of working electron gun electrodes having an improved focussing characteristic and workability.

According to this invention there is provided a method of forming an electron gun electrode of a color picture tube comprising the steps of forming three spaced openings through a metal plate; squeezing the metal plate to form three inverted cup shaped cylindrical projections having the openings at their top centers; coining inner peripheries of the openings to enlarge the same and to form bevelled portions around the peripheries of the enlarged openings, and increasing inner diameters of the cylindrical projections thereby obtaining the electrodes integrally formed with three adjacent cylindrical projections.

DESCRIPTION OF THE PREFERRED EMBODIMENT

Figure 1:
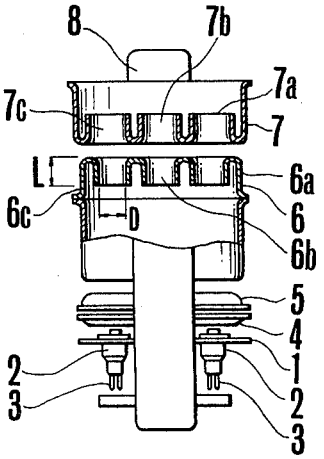
FIG.1 PRIOR ART
FIG. 1 is a longitudinal sectional view showing one example of a conventional in-line type electron gun structure.
Figure 2:
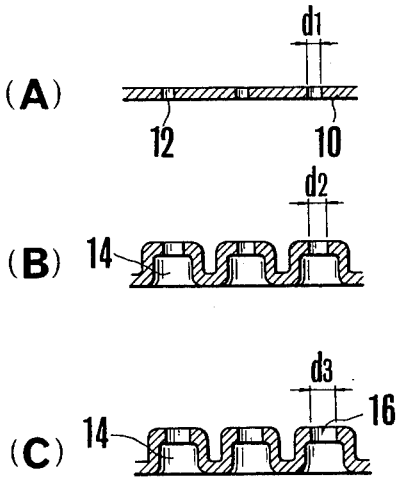
FIG.2 PRIOR ART
FIGS. 2A through 2E are sectional views showing successive steps of manufacturing an electron gun electrode according to a prior art method.
Figures 4A, 4B, 4C, 4D, 4E, 4F:
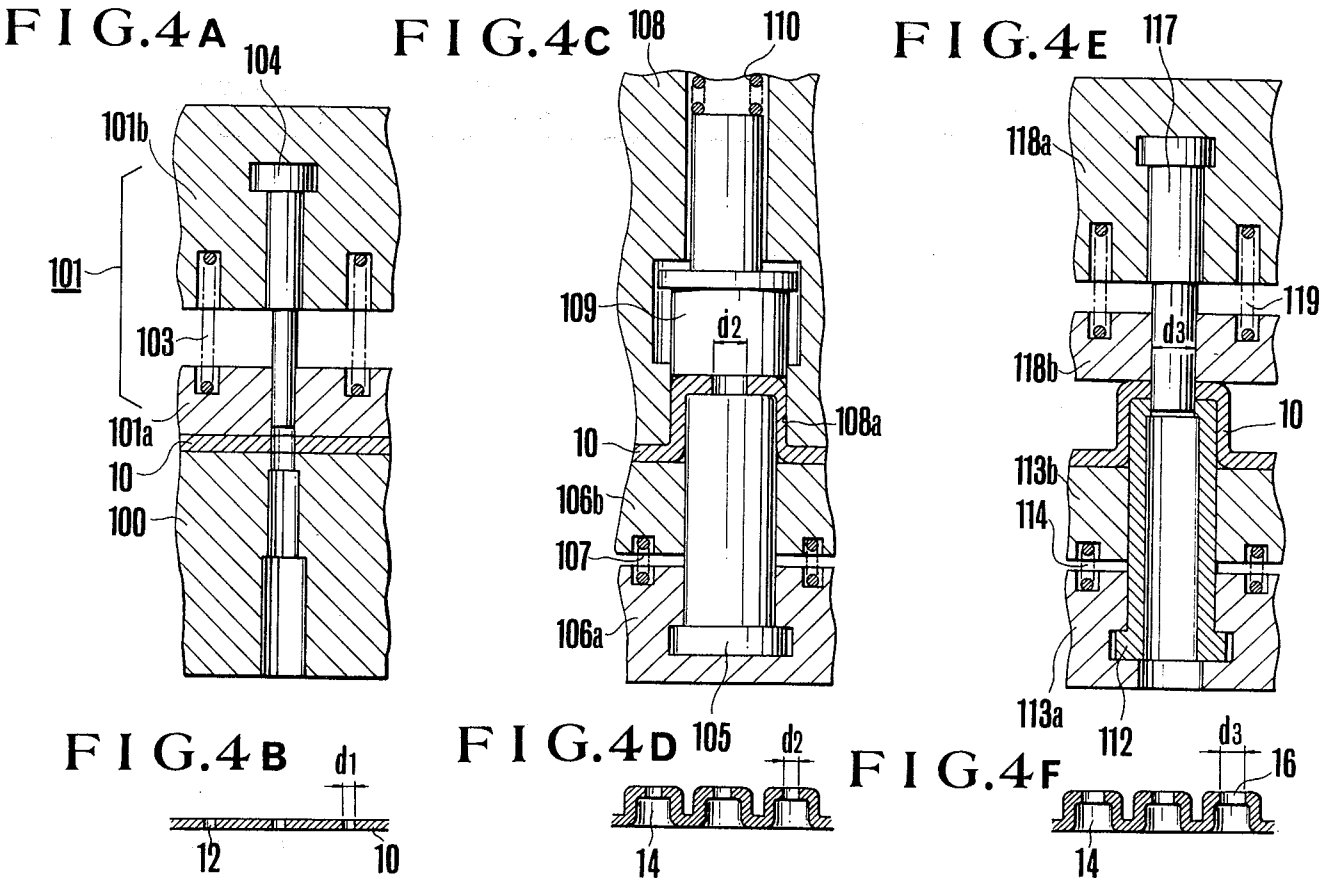
Figure 4G:
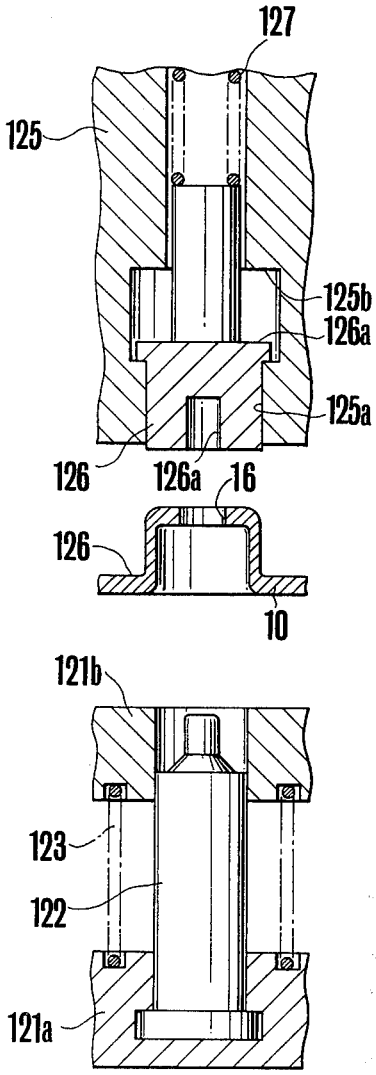
Figure 4H:
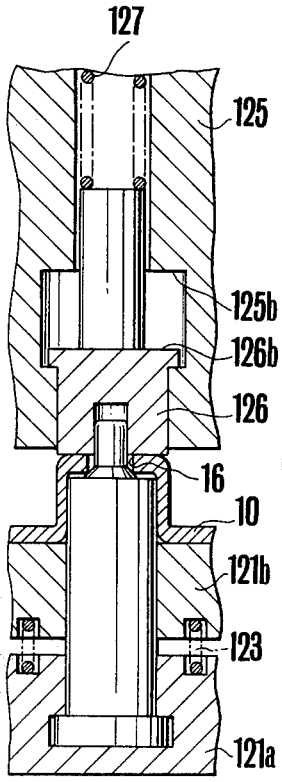
Figure 4I:
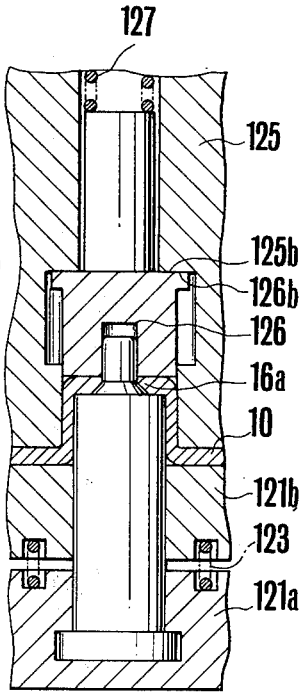
Figure 4J:
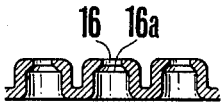
Figure 4L:
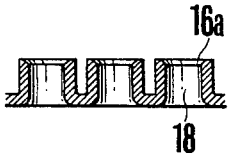
Figure 4K:
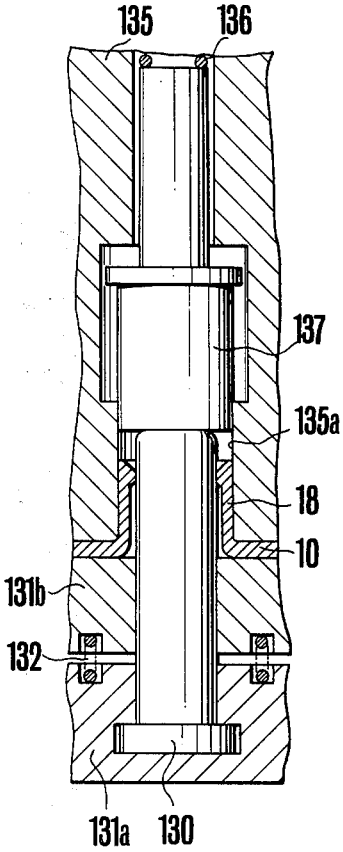
Figure 4M:
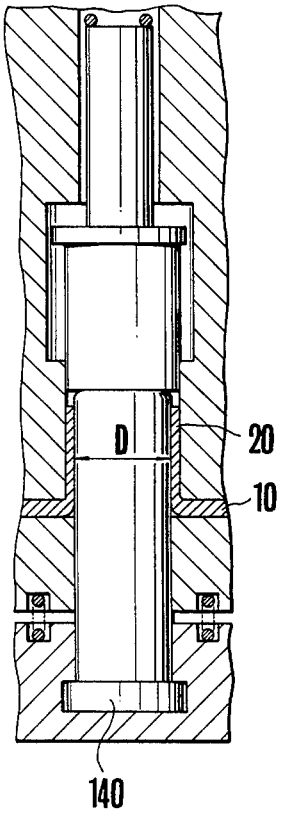
Figure 4N:
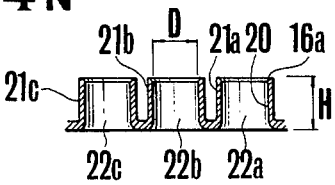

In the accompanying drawings, FIGS. 4A through 4N show successive steps of working electron gun electrodes, especially of the in-line type electron gun, in which portions corresponding to those shown in FIG. 2 are designated by the same reference charactors. At first a blank plate made of stainless steel is squeezed to form an outer cylinder 61 of the third grid electrode 6, for example, shown in FIG. 1 with a metal mold. Then the step is advanced to the boring step shown in FIG. 4A. In the following, an arrangment in which three cylindrical electrodes are disposed in the outer cylinder with a predetermined spacing will be described. The blank formed into the outer cylinder is mounted on a female metal mold 100 with the opening of the outer cylinder directed upwardly. Then a male metal mold 101 is lowered. Then holding mold 101*a* of the male mold 101 is pressed against the blank 10 by means of springs 103. The metal mold 101*b* containing a punch 104 is further lowered to form three openings 12 having an inner diameter d1 through the blank 10 as shown in FIG. 4B.

Then the blank 10 is subjected to a squeezing operation in the step shown in FIG. 4C. In this step, the blank 10 formed with openings 12 is mounted on a lower metal mold 106 constituted by a metal mold 106*a* with a pillar shaped punch 105 mounted at the top, and a metal mold 106*b* having an opening through which the punch passes through and urged against the metal mold 106*a* by springs 107. Under this state an upper metal mold 108 is lowered which is formed with a squeezing opening 108*a* in which a receiver 109 is contained. The receiver 109 is biased downwardly by a spring 110. The downward movement of the mold 108 is continued after the metal mold 108*a* has engaged the blank 10, thus lowering the same together with the lower metal mold 106*b* against the force of the springs 107. Consequently, inverted cup shaped projections 14 having diameters larger than those of openings 12 are formed. At this time, the portions of the blank surrounding the openings 12 are pulled to enlarge the diameters d1 of the openings 12 to d2 as shown in FIG. 4D. Thus, openings 12 having a diameter d2 are precisely positioned at the tops of the projections 14.

Then the blank formed with the projections 14 is transferred to a step shown in FIG. 4E in which the blank 10 shown in FIG. 4D is mounted on the lower metal mold 113 constituted by a metal mold 113*a* containing a cylindrical metal mold 112 having a central opening for forming enlarged openings at the tops of the projections 14, and a metal mold 113*b* supported on the metal mold 113*a* through springs 114. The upper metal mold 116 is lowered under this state. The upper metal mold 116 is constituted by a metal mold 118*a* including a punch 117 having a diameter of d3 and a metal mold 118*b* having a central opening through which the punch passes through and supported on the metal mold 118*a* through springs 119. During the lowering of the metal mold 118, when the metal mold 118*b* comes into contact with the tops of the projections of the blank 10, the metal mold 108*b*, the blank 10 and the metal mold 113*b* are lowered by the force of spring 119 against the force of the spring 114. By this operation, enlarged openings 16 are formed through the blank 10 by the punch 117, as shown in FIG. 4F.

The foregoing steps are identical to the steps shown in FIGS. 2A, 2B and 2C. The coining working steps characterizing the invention will be described hereunder with reference to FIGS. 4G through 4I.

A lower metal mold 121 utilized in these steps comprises a metal mold 121*a* provided with a coining punch 122, and a metal mold 121*b* having a central opening through which the coining punch 122 passes through and mounted on the metal mold 121*a* through springs 123.

Figure 5:
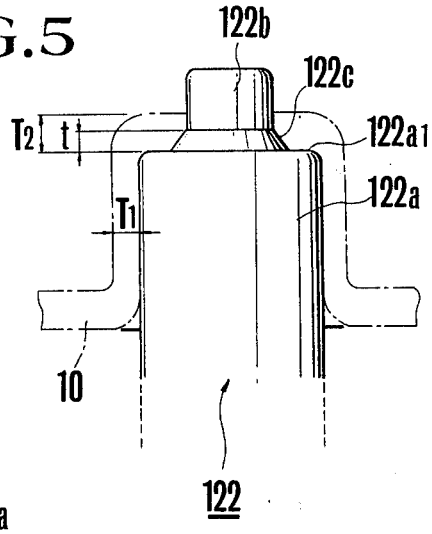
FIG. 5 is a side view showing one example of a punch utilized in the coining performed in the steps shown in FIGS. 4G through 4I.

As shown by an enlarged view shown in FIG. 5, the punch 122 utilized at this time has a cylindrical projection 122*b* having a diameter substantially equal to or a little smaller than the diameter of the openings 16 of the projections 14, a pillar shaped portion 122*a* having a larger diameter than the projection 132*b* and a tapered portion 122*c* between the bottom of the projection 122*b* and the upper flat portion of the pillar shaped portion 122*a*. The width of the tapered portion 122*c* gradually decreases from the flat top portion 122*a* of the pillar shaped portion 122*a* toward the projection 122*b*.

As shown in FIG. 4G, the upper metal mold 125 is formed with a coining working opening 125*a* adapted to contain a punch receiver 126. The punch receiver 126 is provided with relief opening 126*a* at a position confronting the punch 122 of the lower metal mold 121 and normally biased downwardly by a spring 127. As shown in FIG. 4G., the blank 10 formed with a larger opening 16 is interposed between the upper and lower metal molds 121 and 125 that is mounted on the metal mold 121*b*, and then the upper metal mold 125 is lowered. During this downward movement, after the metal mold 125 has engaged the top of the projection of the blank 10, the metal mold 125 continues its downward movement together with the metal mold 121*b*. Since the force of the spring 127 is set to be larger than that of the spring 123, the spring 123 would be compressed during the downward movement. As the metal mold 121*b* moved down, the punch 122 is gradually forced into the projection of the blank so that the projection 122*b* pierces through the opening 16. This state is shown in FIG. 4H. Thereafter, as the metal mold 15 is further moved down, the receiver 126 is moved upwardly against the force of the spring 127 and the downward movement of the metal mold 125 is stopped when the upper edge 126*a* of the receiver 126 reaches the upper end 125*b* of the opening 125*a*. At this time, the punch 122 penetrates through the opening 16 of the blank 10 as shown in FIG. 4I so as to form a bevelled portion 16*a* on the lower edge of the opening 16. Thereafter, the upper metal mold 125 is raised to take out coined blank 10 as shown in FIG. 4J. The size of the bevelled portion 16*a* should be larger than to/To = $\frac{1}{3}$ in order to retain the bevelled portion after stretching (to be described later) in which To represents the thickness of the blank 10 and to the thickness of the bevelled portion.

Typical numerical data of the coining operation will be illustrated with reference to FIG. 5. Thus, where the thickness of the blank To = 0.3 mm, the thickness of the side wall of the projection T1 = 0.25 mm, the diameter of the pillar shaped portion 122 of the punch is 5 mm and to = 0.15 mm.

Then the step is advanced to the boring or burring step shown in FIG. 4K in which a metal mold 131*a* containing a punch 130 having a diameter sufficiently larger than the diameter d3 (see FIG. 4F) of the opening 16, and a metal mold 131*b* having an opening through which the punch 130 passes through and supported by springs 132 are used as a lower metal mold. An upper metal mold 135 has an opening 135*a* containing a receiver 137 biased by a spring 136. In the same manner as the coining operation described above, the upper metal mold 135 is lowered to form bevelled portions 16*a* on the top of the cylindrical projections 18 as shown in FIG. 4L. In the stretching step shown in FIG. 4M, a punch 140 having a diameter of D and metal molds similar to those of FIG. 4K are used so as to form an electrode having cylindrical projections 21*a*, 21*b* and 21*c* as shown in FIG. 4N, that is to form lenses 22*a*, 22*b* and 22*c*. The electrode thus formed has a degree of true circle of less than 40 microns and a ratio H/D of larger than 0.5 required for a main lens component.

Figure 3:
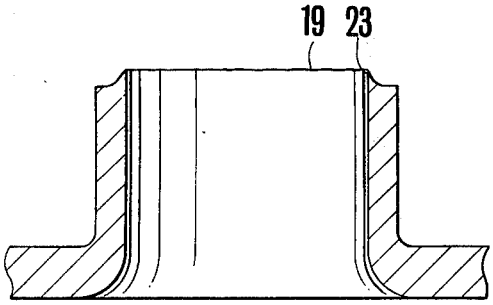
FIG.3 PRIOR ART
FIG. 3 is an enlarged view showing one of the cylindrical projection shown in FIG. 2E, FIGS. 4A through 4D are sectional views showing successive steps of working electron gun electrodes according to the method of this invention.
Figure 6:
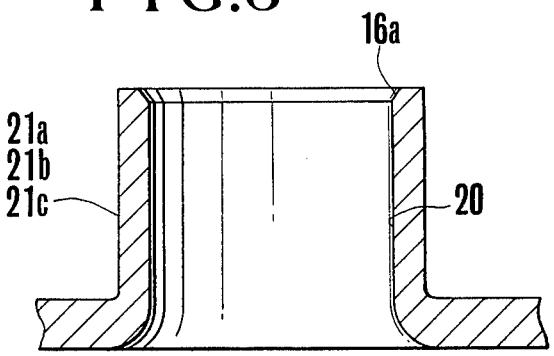
FIG. 6 is a longitudinal sectional view showing one of the cylindrical portions of the electrodes constituting the main lens prepared by the method of forming according to this invention.
Figure 7:
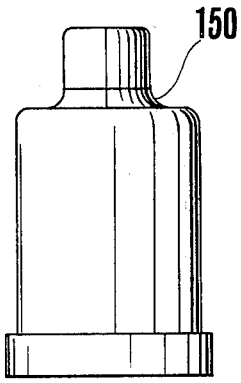
FIG. 7 is a front view showing another example of the punch utilized in the coining operation.

As above described, since bevel forming steps (FIGS. 4G–4J) are added between the step of forming small openings 16 (FIG. 4F) and the step of forming large openings (FIG. 4L), even when the blank is stretched greatly (FIG. 4M and 4N), surplus material of the walls 20 is removed by bevelled off portion so that the upper end of the cylindrical projection would have a uniform shape around the periphery as shown in FIG. 6, thus eliminating the sharp edge 23 shown in FIG. 3. As a consequence, the cylindrical portions 21*a*, 21*b* and 21*c* have necessary degree of true circle over their entire length. Since bevelled portions 16*a* are provided, an assembling jig can readily be inserted into the openings of the cylindrical projections without deforming them.

Although in the foregoing description, the ratio L/D was assumed to be larger than 0.5, this ratio may be less than 0.5.

As above described, since one ends of three cylindrical projections are bevelled and have uniform shape about their peripheries, it is possible to improve the focussing characteristic and the asembling of the electron gun structure.

It should be understood that the invention is not limited to the embodiment described above and that various changes and modifications will be obvious to one skilled in the art. For example, the bevelling portion of the punch used for coining may be curved portion 150 having a sectional configuration of a funnel. The invention is also applicable to a delta type electron gun assembly instead of the in-line type.

What is claimed is:

1. A method of forming an electron gun electrode of color picture tube comprising the steps of:

forming three spaced openings through a metal plate;

squeezing said metal plate to form three inverted cup shaped cylindrical projections having said opening at their top centers;

coining inner peripheries of said openings to enlarge the same and to form bevelled portions around the peripheries of the enlarged openings wherein said bevelled portion has a thickness of more than one third of the thickness of the metal plate; and increasing inner diameters of said cylindrical projections thereby obtaining the electrode integrally formed with three adjacent cylindrical projections.

2. The method according to claim 1 which further comprises the step of stretching said cylindrical projections.

3. The method according to claim 1 wherein each of said bevelled portion is formed by using a coining punch comprising a pillar shaped base having a diameter substantially equal to the inner diameter of the inverted cup shape cylindrical projections, a projection at the center of the top of the base and having a diameter smaller than that of said opening, said projection forming a space to permit elongation of an inner edge of said opening at the time of bevelling, and a bevelling member formed at the base of said space.

4. The method according to claim 3 wherein said bevelled portion is tapered toward a central opening of said cylindrical projection.

* * * * *